US007753076B2

(12) United States Patent
Mita

(10) Patent No.: US 7,753,076 B2
(45) Date of Patent: Jul. 13, 2010

(54) ELECTROMAGNETIC VALVE

(75) Inventor: Minehiko Mita, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 708 days.

(21) Appl. No.: 11/626,048

(22) Filed: Jan. 23, 2007

(65) Prior Publication Data

US 2007/0178753 A1 Aug. 2, 2007

(30) Foreign Application Priority Data

Jan. 30, 2006 (JP) ..... 2006-021224

(51) Int. Cl.
*F15B 13/043* (2006.01)

(52) U.S. Cl. ..... 137/625.64; 439/696; 439/465; 439/687; 439/353; 439/357

(58) Field of Classification Search ..... 137/625.64, 137/625.65, 884; 439/696, 465, 687, 353, 439/357, 378, 76.1, 76.2
See application file for complete search history.

(56) References Cited

U.S. PATENT DOCUMENTS 2,457,028 A * 12/1948 Bors ..... 219/534
3,594,696 A * 7/1971 Witek, Jr. ..... 439/278
6,231,392 B1 * 5/2001 van Woensel ..... 439/607.44
6,840,273 B2 * 1/2005 Miyazoe et al. ..... 137/554
7,032,879 B2 4/2006 Hayashi
2004/0222397 A1 * 11/2004 Hayashi ..... 251/129.09

FOREIGN PATENT DOCUMENTS

| | | |
|---|---|---|
| CN | 1128418 A | 8/1996 |
| JP | 62-3909 | 1/1987 |
| JP | 7-335305 | 12/1995 |
| KR | 10-0354449 | 12/2002 |
| KR | 10-2004-0095729 | 11/2004 |
| KR | 20-0404077 | 12/2005 |

* cited by examiner

*Primary Examiner*—John Rivell
*Assistant Examiner*—Craig M Schneider
(74) *Attorney, Agent, or Firm*—Oblon, Spivak, McClelland, Maier & Neustadt, L.L.P.

(57) ABSTRACT

A feeder terminal connected to the core wire of the feeder cable is installed in the storage chamber of the terminal storage box, and the feeder cable and the feeder terminal are gripped to be fixed between the terminal storage box and the lid such that the feeder socket is assembled. The feeder socket is inserted into the socket hole formed in the terminal cover to connect the feeder terminal to the power receiving terminal communicated with the electromagnetic operation unit.

10 Claims, 7 Drawing Sheets

ELECTROMAGNETIC VALVE

TECHNICAL FIELD

The present invention relates to an electromagnetic valve provided with a passage switching unit that switches a fluid passage, an electromagnetic operation unit that operates the passage switching unit, and a feeder unit that applies electric current to the electromagnetic operation unit.

BACKGROUND ART

An electromagnetic valve provided with a passage switching unit that includes a valve body to switch the fluid passage, an electromagnetic operation unit that includes a movable iron core and a magnetizing coil for operating the valve body, and a feeder unit that supplies electric current to the magnetizing coil has been well known.

For example, Patent Document 1 discloses the feeder unit of the electromagnetic valve in which a top end of the core wire of the feeder cable is connected to a tubular terminal through pressure bonding, and the tubular terminal and the feeder cable are inserted into a terminal storage hole formed in a body of a terminal box (feeder socket) so as to be assembled. The assembled feeder socket is attached to a socket mount on the side surface of the electromagnetic valve so as to be conducted to the feeder cable by fitting the tubular terminal with a coil terminal that protrudes from the socket mount.

In the aforementioned generally employed feeder unit as disclosed in Patent Document 1, the feeder socket is assembled by inserting the terminal or the feeder cable into a hole or a cylinder formed in a body of the box, which requires manual operations as the relatively difficult and time consuming work. Patent Document 1: Utility Model Application Publication No. S62-3909

DISCLOSURE OF INVENTION

An object of the present invention is basically to simplify assembly of a feeder unit for feeding power to the electromagnetic operation unit, and attachment of the feeder unit to the electromagnetic valve.

Another object of the present invention is to simplify assembly of the feeder socket of the feeder unit and connection thereof to the electromagnetic valve by interposing to fix the feeder cable and the feeder terminal linked therewith between the terminal storage box and the lid without external insertion into the hole or the cylinder formed in the socket in the generally employed feeder unit.

In order to solve the aforementioned problem, the electromagnetic valve according to the present invention includes an electromagnetic valve body formed of a passage switching unit and an electromagnetic operation unit for operating the passage switching unit, and a feeder unit for supplying power to the electromagnetic operation unit. In the electromagnetic valve, the feeder unit includes a power receiving terminal which is provided on a side surface of the electromagnetic valve body and conducted to the electromagnetic operation unit, a terminal cover attached onto the side surface of the electromagnetic valve body to cover the power receiving terminal, a socket hole formed at a position corresponding to the power receiving terminal covered by the terminal cover, and a feeder socket attached to a top end of a feeder cable so as to be installed within the socket hole. The feeder socket includes a terminal storage box having a rectangular box shape and an open front surface and a lid for covering the open front surface of the terminal storage box, and the feeder cable and a feeder terminal are interposed between the terminal storage box and the lid which are connected with each other to integrally assemble the feeder socket to be installed within the socket hole such that the feeder terminal and the power receiving terminal are electrically coupled with each other.

According to the preferred embodiment of the present invention, semi-circular grooves are formed at opposite positions for introducing the feeder cable on the terminal storage box and the lid such that the feeder cable is gripped between the semi-circular grooves.

According to the present invention, preferably a protrusion formed at one of the terminal storage box and the lid is fixed to a fixing window formed at the other one such that they are integrally connected with each other. Specifically, preferably the terminal storage box includes left and right elastically deformable side walls and a plurality of fixing windows formed on the side walls, and the lid is elastically fit with a portion between the left and the right side walls such that a plurality of the protrusions formed on both side surfaces of the lid are fixed to the fixing windows.

Preferably, according to the present invention, at least one of a plurality of walls that surround the socket hole is formed as an elastic wall, and a hook is formed on an inner surface of the elastic wall, a claw is formed on a plane opposite the elastic wall such that the feeder socket is installed in the socket hole so as not to be fallen out through an elastic engagement between the claw and the hook.

More preferably, two opposite walls of the socket hole are formed as the elastic walls, and the claws are formed on back surfaces of the terminal storage box and the lid of the feeder socket, respectively.

In this case, the elastic walls extend to a depth of the hole from an end portion at an inlet side of the socket hole as a supporting point, and an end portion at the depth side is made elastically deformable to be close to or remote from the claws of the feeder socket.

According to the present invention, a stepped portion may be formed to surround a top end of the socket hole, and flange portions are formed around an outer periphery of a top end of the feeder socket such that the flange portions abut against the stepped portion to be fixed upon insertion of the feeder socket into the socket hole.

The above-described electromagnetic valve according to the present invention allows the assembly of the feeder unit for supplying power to the electromagnetic operation unit and its installment to the electromagnetic valve to be simply performed. Especially, unlike the generally employed feeder unit, assembly of the feeder socket of the feeder unit and its connection to the electromagnetic valve may be easily performed by gripping the feeder cable and the feeder terminal linked therewith to be fixed between the terminal storage box and the lid without external insertion thereof into the hole or the cylinder formed in the socket.

BEST MODE FOR CARRYING OUT THE INVENTION

Figure 1:
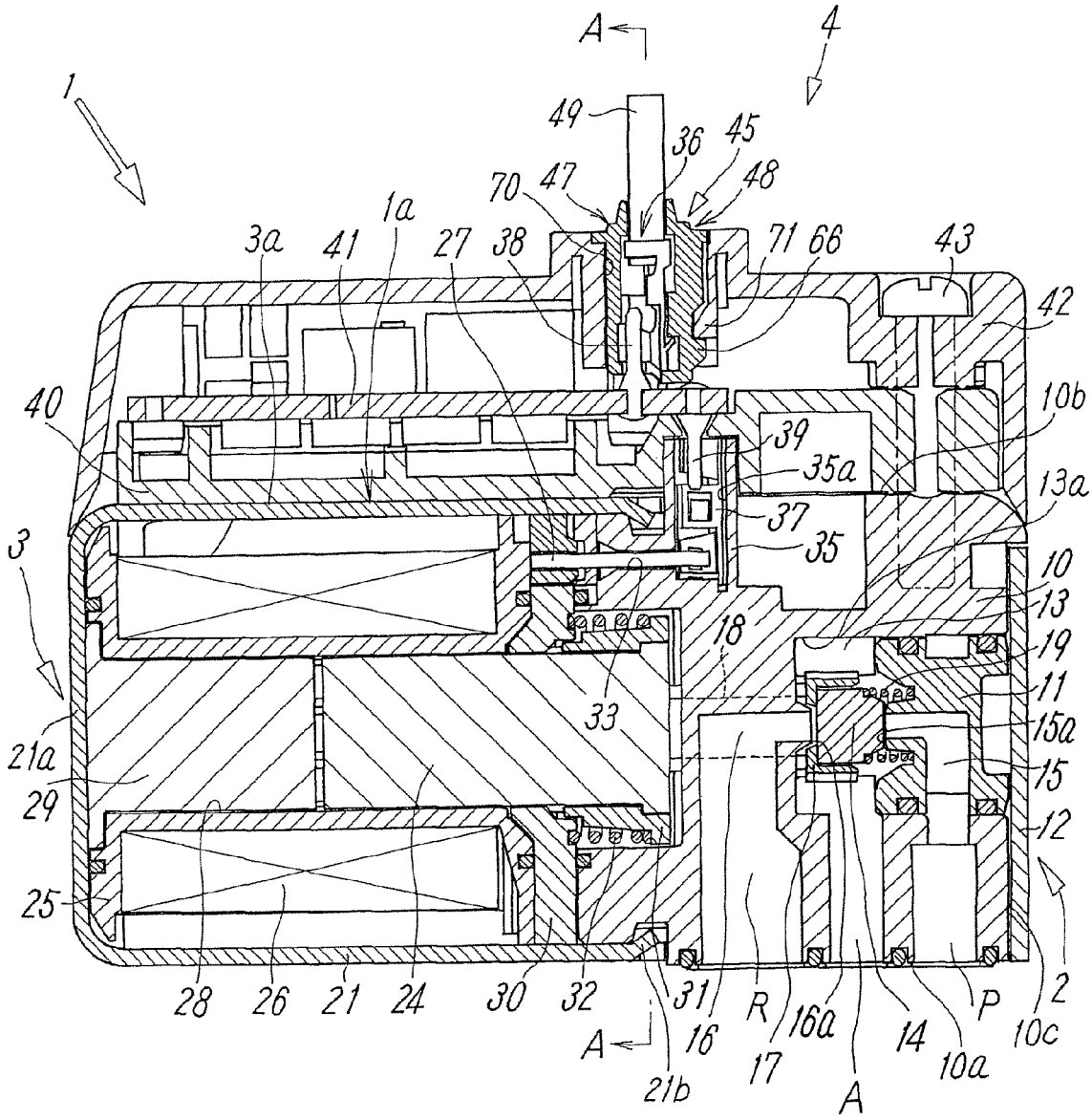
FIG. 1 is a longitudinal sectional view of a first embodiment of the present invention.

Embodiments of the present invention will be described referring to the drawings.

Referring to FIG. 1, an electromagnetic valve according to the present invention is generally formed of an electromagnetic valve body 1 including a passage switching unit 2 formed as a three-port type directional switching valve and an electromagnetic operation unit 3 for operating the passage switching unit, and a feeder unit 4 that supplies power to the electromagnetic operation unit 3.

The passage switching unit 2 includes a valve body 10 formed as a substantially square block having its first side surface 10*a* provided with a feed port P, an output port A, and a discharge port R. The valve body 10 has a circular hole 13*a* that forms a valve chamber 13 in the direction from an end surface 10*c* opposite the end surface connected to the electromagnetic operation unit 3 to the inside the valve body 10. A valve seat block 11 is fit with the hole 13*a* to be fixed therein by a fixing plate 12 attached to the end surface 10*c*. The valve chamber 13 defined by the valve seat block 11 within the hole 13*a* is provided with a poppet type valve body 14 so as to be reciprocally moved along the axial direction of the hole 13*a*.

The valve seat block 11 includes a feed passage 15 that communicates the feed port P with the valve chamber 13. Meanwhile, the valve body 10 includes a discharge passage 16 that communicates the discharge port R with the valve chamber 13. A feed valve seat 15*a* around the opening of the feed passage 15 is positioned opposite a discharge valve seat 16*a* around the opening of the discharge passage 16 within the valve chamber 13. The valve body 14 locates between those valve seats, and is held by an annular valve holder 17. A plurality of push rods 18 are provided reciprocally movable with a movable iron core 24 (described later) between the valve holder 17 and the movable iron core 24. A valve spring 19 is disposed between an annular groove around the feed valve seat 15*a* and the valve body 14. The elastic force of the valve spring 19 urges the valve body 14 toward the discharge valve seat 16*a*.

An annular bobbin 25 is stored within a hollow magnetic cover 21 which has a circular or a rectangular cross section and one open end portion of the electromagnetic operation unit 3. A coil 26 is wound around the bobbin 25, and has both ends connected to a pair of coil terminals 27 each protruding in parallel from the bobbin 25 to be fit within a terminal receiving hole 33 of the valve body 10. FIG. 1 shows only one coil terminal connected to one end of the coil 26, and does not show the other coil terminal and associated members for feeding power. An inner hole 28 of the bobbin 25 includes a fixed iron core 29 in contact with an end wall portion 21*a* of the magnetic cover 21 and a movable iron core 24 which is magnetically attracted to the fixed iron core 29 and allowed to displace.

Within the aforementioned magnetic cover 21, a magnetic plate 30 is interposed between the bobbin 25 and the valve body 10. An outer periphery of the magnetic plate 30 abuts against the inner surface of the magnetic cover 21 such that the magnetic cover 21 and the magnetic plate 30 are magnetically connected with each other. The inner hole of the magnetic plate 30 has the same diameter as that of the inner hole 28 of the bobbin 25.

An annular synthetic resin cap 31 is fixed to a top end of the movable iron core 24. A return spring 32 is interposed between a flange-like spring washer at the top end of the cap 31 and the annular groove of the magnetic plate 30.

The passage switching unit 2 is connected to the electromagnetic operation unit 3 by calking a fixing portion 21*b* formed as a part of the magnetic cover 21 so as to be fixed to a recess portion of the valve body 10.

FIG. 1 shows the state where the coil 26 is not excited. In this state, the return spring 32 which exhibits the spring force stronger than that of the valve spring 19 urges the movable iron core 24 toward the valve body 10 against the urging force of the valve spring 19. The resultant urging force is transferred to the valve body 14 via the push rods 18 and the valve holder 17 such that the valve body 14 abuts the feed valve seat 15*a* of the valve seat block 11 to be closed, and the discharge valve seat 16*a* is opened. Accordingly, the communication between the feed port P and the valve chamber 13 is interrupted, and the communication between the output port A and the discharge port R is allowed.

When the coil 26 is excited through application of electric current, the fixed iron core 29 generates the magnetic suction force to allow the movable iron core 24 to be attracted thereto. Then the valve body 14 opens the feed valve seat 15*a*, and closes the discharge valve seat 16*a*. Accordingly, the communication between the discharge port R and the valve chamber 13 is interrupted, and the communication between the feed port P and the output port A is allowed.

A rectangular hollow terminal storage portion 35 that protrudes outward from the second side surface 10*b* is formed integrally with the valve body 10 at a position near the electromagnetic operation unit 3 on the second side surface 10*b* opposite the first side surface 10*a* of the valve body 10 on which the ports P, A and R are formed. The terminal storage portion 35 is formed at the position corresponding to the top end portion of the coil terminal 27 that extends parallel to the second side surface 10*b*, and provided with two hollow portions 35*a* therein each reaching the corresponding coil terminal 27. Each of the hollow portions 35*a* stores a first relay terminal 37 electrically coupled with the corresponding coil terminal 27.

The second side surface 10*b* of the valve body 10 and a side surface 3*a* of the electromagnetic operation unit 3 form a substantially flat or a nearly flat single surface without a portion greatly protruding outward except the terminal storage portion 35. The surface allows a terminal mount surface 1*a* to be formed on the side surface of the electromagnetic valve body 1. A terminal table 40 is disposed on the terminal mount surface 1*a*, on which a substrate 41 is installed. A terminal cover 42 that covers the terminal table 40 and the substrate 41 is attached to the electromagnetic valve body 1.

Two power receiving terminals 38, 38 each top end of which protrudes from the upper surface of the substrate 41 are fixed thereto. The top end of the power receiving terminal 38 locates at the inner bottom portion of a rectangular socket hole 70 that opens to the upper surface of the terminal cover 42 at the position near the center thereof. Each of the power receiving terminals 38 is electrically coupled with each of two feeder terminals 36, 36 through plug-in within the feeder socket 45 installed in the socket hole 70, respectively. Two second relay terminals 39, 39 each top end of which protrudes downward to the valve body 10 are fixed to the substrate 41. Each of the second relay terminals 39 is electrically coupled with the first relay terminal 37 within the terminal storage portion 35, respectively. The second relay terminal 39 has its top end connected to the first relay terminal 37 through plug-in when the substrate 41 is installed to the terminal table 40 parallel to the terminal mount surface 1*a*. Electronic parts required for controlling current application are fixed to the substrate 41, through which the power receiving terminals 38 and the second relay terminals 39 are electrically coupled with one another.

Figure 5:
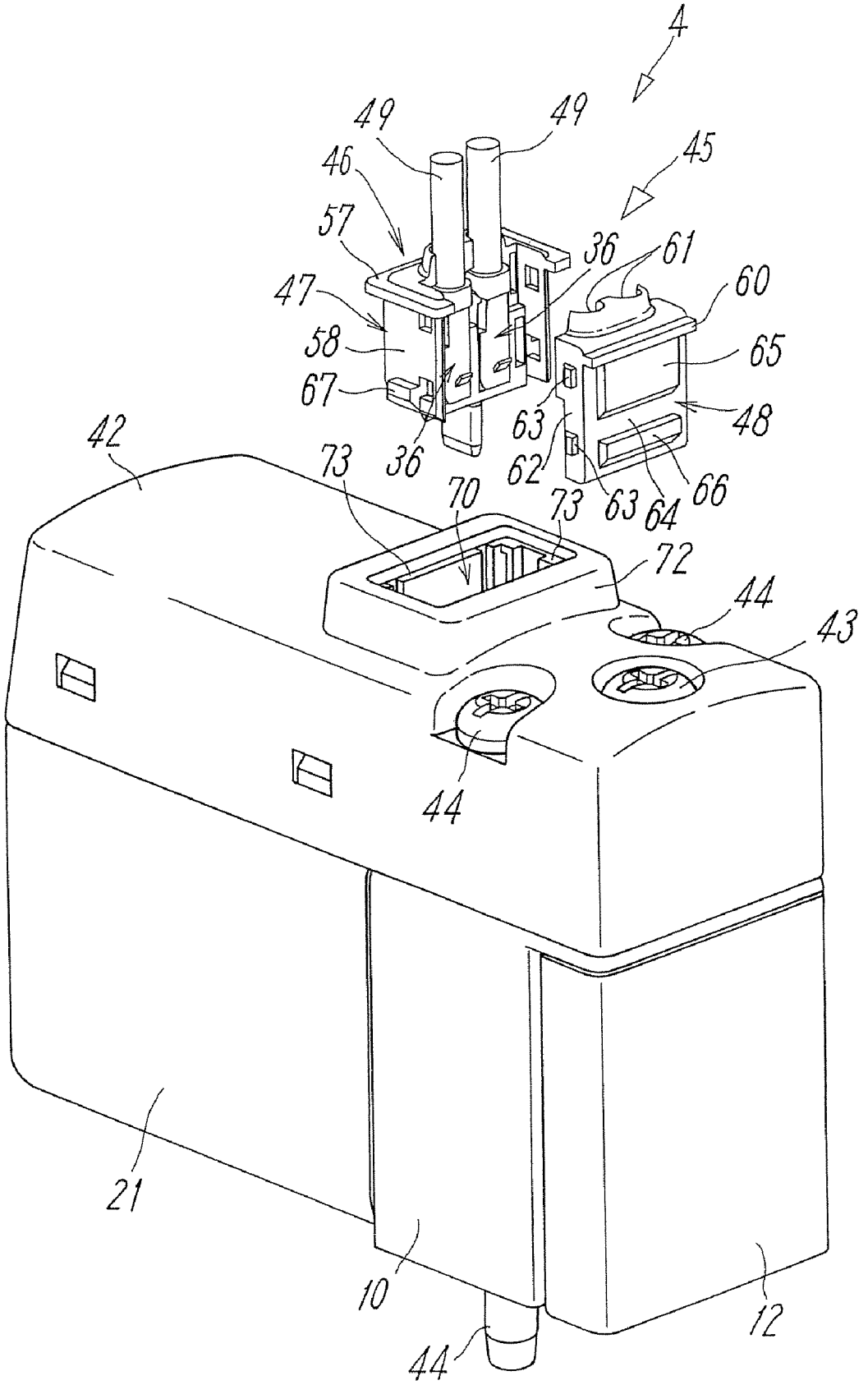
FIG. 5 is a perspective view showing the state before assembly of the feeder socket which has not been inserted into the insertion hole of the terminal cover.
Figure 6:
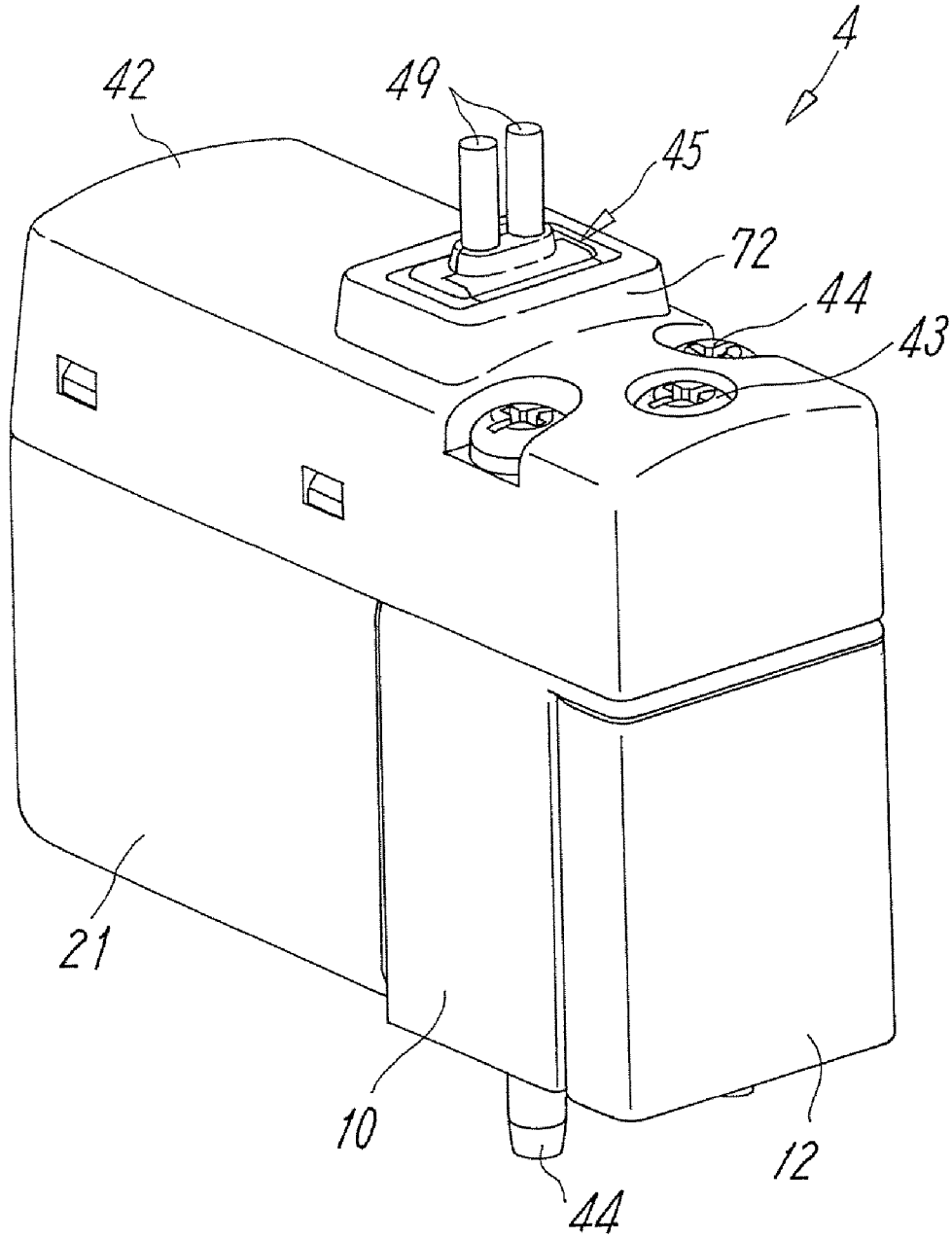
FIG. 6 is a perspective view showing the state where the feeder socket has been assembled to be installed into the insertion hole of the terminal cover.

Referring to FIGS. 1 and 5, the terminal cover 42 has a size corresponding to the area defined by the passage switching unit 2 and the electromagnetic operation unit 3 to cover the terminal mount surface 1*a* entirely, and is fixed to the valve body 10 with a cover fixing screw 43. Trough holes formed in the terminal cover 42, the terminal table 40, and the valve body 10 allow two screws 44 for fixing the electromagnetic valve to be inserted therethrough for attaching the electromagnetic valve to the manifold and the like.

The feeder socket 45 inserted into the socket hole 70 will be described referring to FIGS. 1 to 6.

Figure 2:
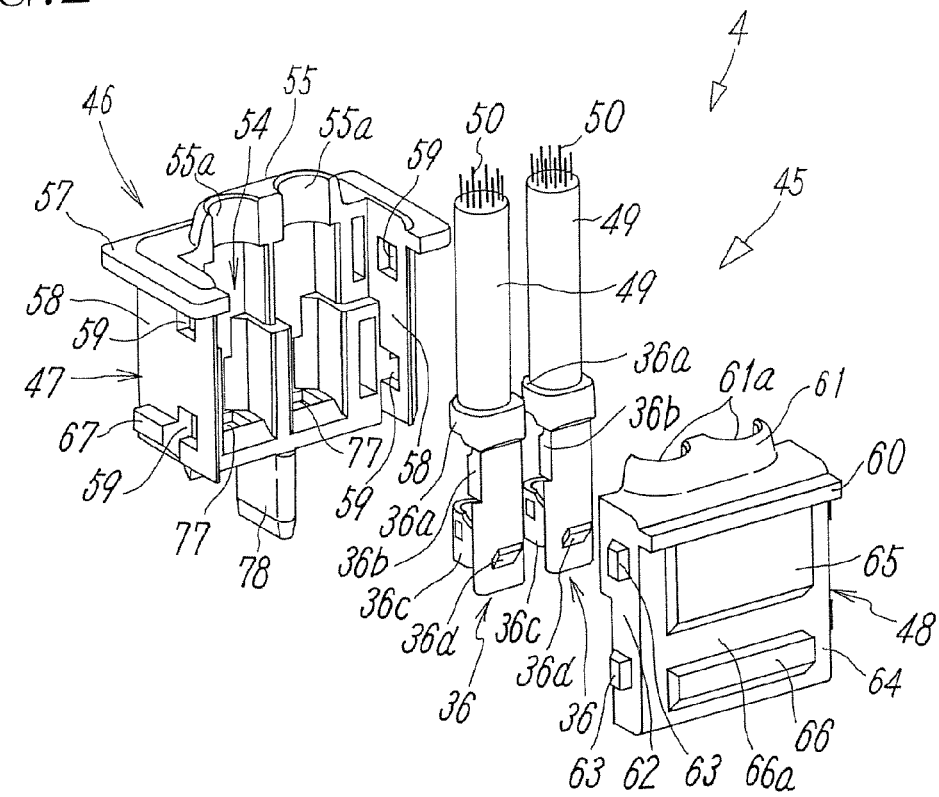
FIG. 2 is an exploded perspective view of the feeder socket.
Figure 4:
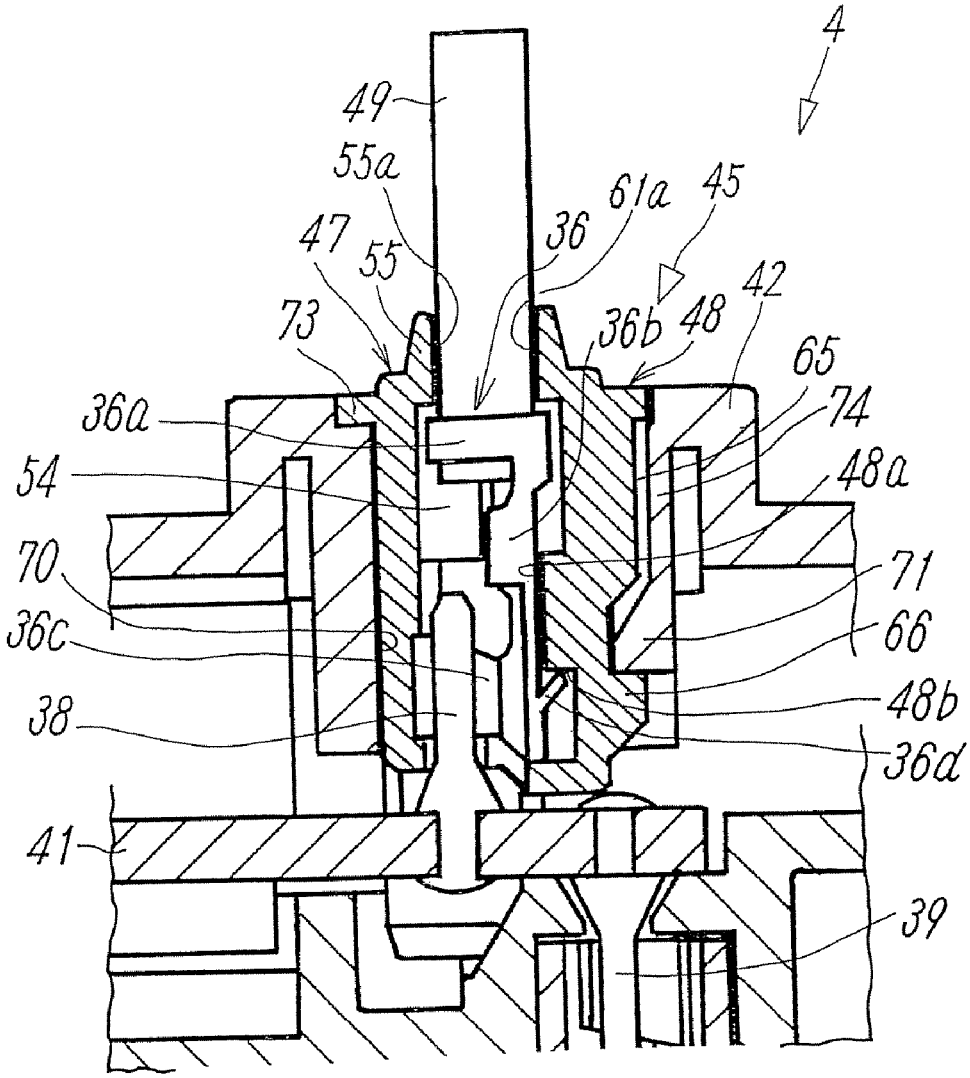
FIG. 4 is an enlarged sectional view of an essential portion shown in FIG. 1.

Referring to FIG. 2, the feeder socket 45 includes a separate type housing 46 formed of a rectangular box-shape terminal storage box 47 having an open front surface and a rectangular lid 48 that closes the open front surface of the terminal storage box 47, and two feeder terminals 36, 36 stored within the housing 46 and connected to the respective feeder cables 49. The top end of the feeder cable 49 is gripped by a holder arm 36*a* at the base of the feeder terminal 36. A conducting core wire 50 of the feeder cable 49 is electrically coupled with the core wire grip portion 36*b* of the feeder terminal 36 at the position adjacent to the holder arm 36*a*. One side surface of the top end of the feeder terminal 36, that is, the side surface that faces the terminal storage box 47 is integrally provided with a terminal connector 36*c* formed of a substantially cylindrical elastic clip. The other side surface, that is, the side surface that faces the lid 48 is integrally provided with a fixing portion 36*d* that diagonally protrudes toward the base portion of the feeder terminal. A stepped fixing portion 48*b* to which the fixing portion 36*d* is fixed is formed on an inner surface 48*a* of the lid 48 as shown in FIG. 4. The feeder terminal 36 may be prevented from falling out of the housing 46 by fixing the fixing portion 36*d* to the stepped fixing portion 48*b*.

The terminal storage box 47 includes two terminal storage chambers 54, 54 each having a recess groove shape adjacent with each other therein. The feeder terminals 36 connected to the feeder cables 49 are fixed within the storage chambers 54 each extending in the vertical direction. A terminal through hole 77 is formed in each bottom portion of the respective storage chambers 54. The power receiving terminal 38 is inserted into the storage chamber 54 through the through hole 77 such that the power receiving terminal 38 is electrically coupled with the terminal connector 36*c* of the feeder terminal 36 through plug-in.

Guide portions 55 and 61 each including two semi-circular grooves 55*a*, 55*a* and 61*a*, 61*a*, respectively with which the feeder cables 49 are fit are integrally formed at the position where each top end of the terminal storage box 47 and the lid 48 faces with each other. The top end of the feeder cable 49 is fit and gripped between the opposing semi-circular grooves 55*a* and 61*a*.

Referring to FIG. 2, two fixing windows 59, 59 are formed at the upper and the lower portions of the left and right side walls 58 of the terminal storage box 47, respectively. Meanwhile, two protrusions 63 (protrusion 63 on one side surface is only shown) elastically fixed to the fixing windows 59 of the terminal storage box 47 are formed at the upper and the lower portions of the left and right side walls of the lid 48, respectively. Those fixing windows 59 and the protrusions 63 form a fixing mechanism that fixes the terminal storage box 47 and the lid 48 in the assembly state.

In order to install those two feeder terminals 36, 36 to which the feeder cables 49 are connected in the housing 46, firstly, the feeder terminals 36 are stored in the storage chamber 54 of the terminal storage box 47, and the feeder cables 49 are fit with the respective semi-circular grooves 55*a*. Then the left and the right side surfaces 62 of the lid 48 are fit between both side walls 58, 58 at the side of the opening of the terminal storage box 47 such that the lid 48 is strongly pushed inward of the terminal storage box 47. As the side walls 58 of the terminal storage box 47 and the side surfaces 62 of the lid 48 are elastically deformed, and the protrusions 63 of the lid 48 move in contact with the inner surfaces of the side walls 58, the four protrusions 63 are fixed to the four fixing windows 59, respectively.

The housing 46 to be inserted into the socket hole 70 formed in the terminal cover 42 is assembled in the state where the feeder cables 49 and the feeder terminals 36 are gripped to be fixed between the terminal storage box 47 and the lid 48.

It is possible to provide the protrusions 63 on the side walls 58 of the terminal storage box 47, and to provide the fixing windows 59 on the side surfaces 62 of the lid 48.

A convex portion 65 and a first claw 66 raised from the back surface 64 of the lid 48 at a predetermined height are provided at the upper and the lower portions of the back surface 64. A recess portion 66*a* is defined by the convex portion 65 and the first claw 66. The outer surfaces of the lower portion of both side walls 58 of the terminal storage box 47 are integrally provided with second claws 67.

Figure 3:
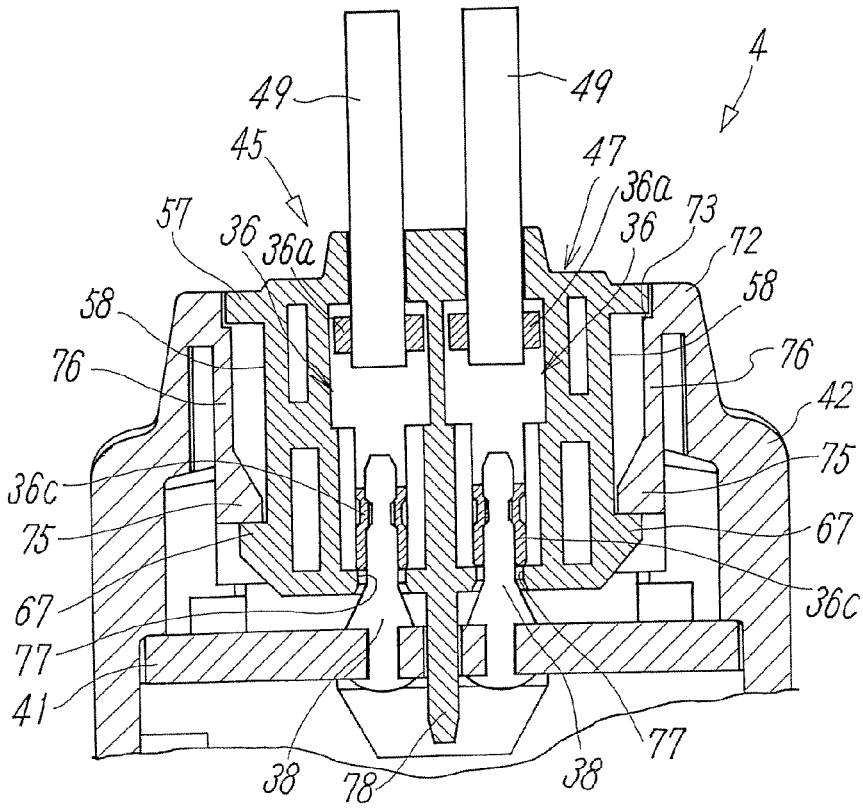
FIG. 3 is an enlarged sectional view of an essential portion of the view taken along line A-A of FIG. 1.

Referring to FIG. 4, one of four walls of the rectangular socket hole 70 formed in the terminal cover 42, which is opposite the back surface 64 of the lid 48 of the housing 46 is formed as a first elastic wall 74 that extends to the depth of the hole from the upper end at the side of an inlet as the supporting point such that the lower end at the depth side is deformable to be close to or remote from the lid 48. A first hook 71 that protrudes inward of the hole, that is, toward the lid 48 is formed at the lower end portion of the first elastic wall 74. Referring to FIG. 3, two walls each orthogonal to the first elastic wall 74, that is, opposite the side walls 58, 58 of the terminal storage box 47 are formed as second elastic walls 76, 76 which are elastically deformable likewise the first elastic wall 74. Second hooks 75 each protruding inward of the hole are formed at the lower portions of the second elastic walls 76, respectively.

In order to install the above-structured feeder socket 45 in the socket hole 70, the back surface 64 of the lid 48 of the housing 46 is directed to face the first elastic wall 74 of the socket hole 70 (see FIGS. 4 and 5), and the side wall 58 of the terminal storage box 47 is directed to face the second elastic wall 76 of the socket hole 70 (see FIGS. 3 and 5). In the aforementioned state, the feeder socket 45 is inserted into the socket hole 70. Then the first claw 66 formed on the back surface 64 of the lid 48 presses the first hook 71 of the first elastic wall 74 to be elastically deformed outward, and the second claw 67 formed on the side wall 58 of the terminal storage box 47 presses the second hook 75 formed on the second elastic wall 76 to be elastically deformed outward. Accordingly in the feeder socket 45, the first and the second claws 66 and 67 stride over the first and the second hooks 71 and 75, respectively to be pushed to the position at which the respective lower surfaces are fixed. The claws 66 and 67 are fixed to the hooks 71 and 75, respectively at the fixed positions.

The first and the second hooks 71 and 75 each formed on the wall of the socket hole 70, and the first and the second claws 66 and 67 formed on the housing 46 constitute the socket fixing mechanism for fixing the feeder socket 45 in the socket hole 70.

Both pairs of the first claw 66 and the first hook 71, and the second claw 67 and the second hook 75 do not have to be formed. It is allowed to provide any one of those pairs.

A protruding frame 72 that protrudes upward from the upper surface of the terminal cover 42 is integrally formed with the portion around the socket hole 70 in the upper surface of the terminal cover 42. A stepped portion 73 is formed on the inner periphery of the protruding frame 72 to surround the upper end portion of the socket hole 70. Meanwhile, flange portions 57 and 60 are formed on the outer periphery of the upper end portion of the feeder socket 45 to stride over the terminal storage box 47 and the lid 48. In the aforementioned state, when the feeder socket 45 is inserted into the socket hole 70, those flange portions 57 and 60 abut on the stepped portion 73 so as to be fixed. Fixation of the claws 66 and 67 to the hooks 71 and 75 in the aforementioned state prevents the feeder socket 45 from falling out. In this way, the feeder socket 45 is installed into the socket hole 70 such that the power receiving terminals 36 within the feeder socket 45 are connected to the power receiving terminals 38 of the substrate 41 so as to be conducted.

A reference numeral 78 in the drawings denotes a positioning plate to be inserted into the groove of the substrate 41.

Once the feeder socket 45 is installed into the socket hole 70, generally it cannot be pulled out from the socket hole 70. However, it is possible to pull out the feeder socket 45 by removing the terminal cover 42 from the electromagnetic valve body 1, and disengaging the hooks 71, 75 from the claws 66, 67 by deforming the respective elastic walls 74, 76 from the lower surface using such tool as a screwdriver.

Figure 7:
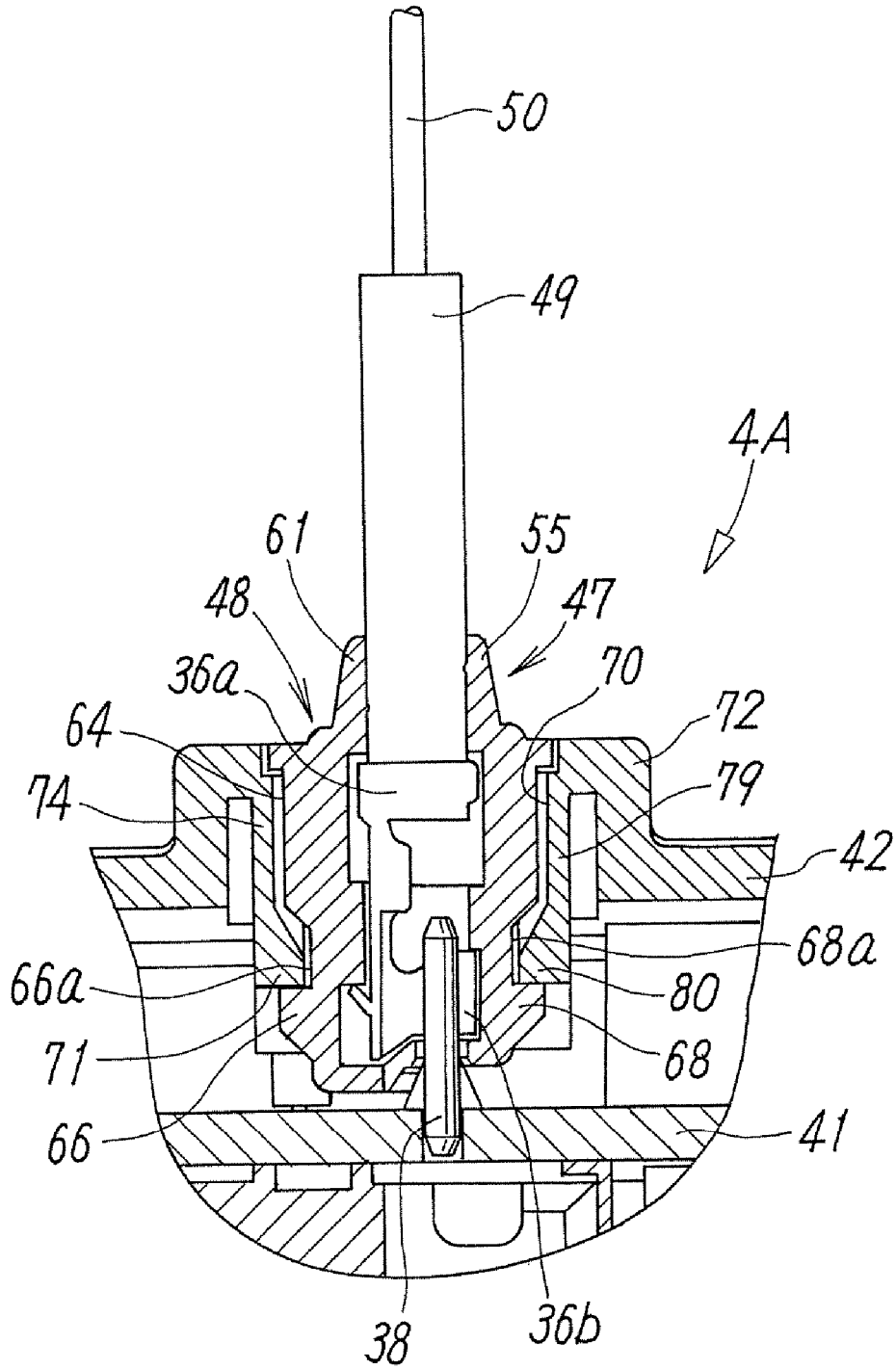
FIG. 7 is a sectional view of the second embodiment according to the present invention at the same position as shown in FIG. 4.
Figure 8:
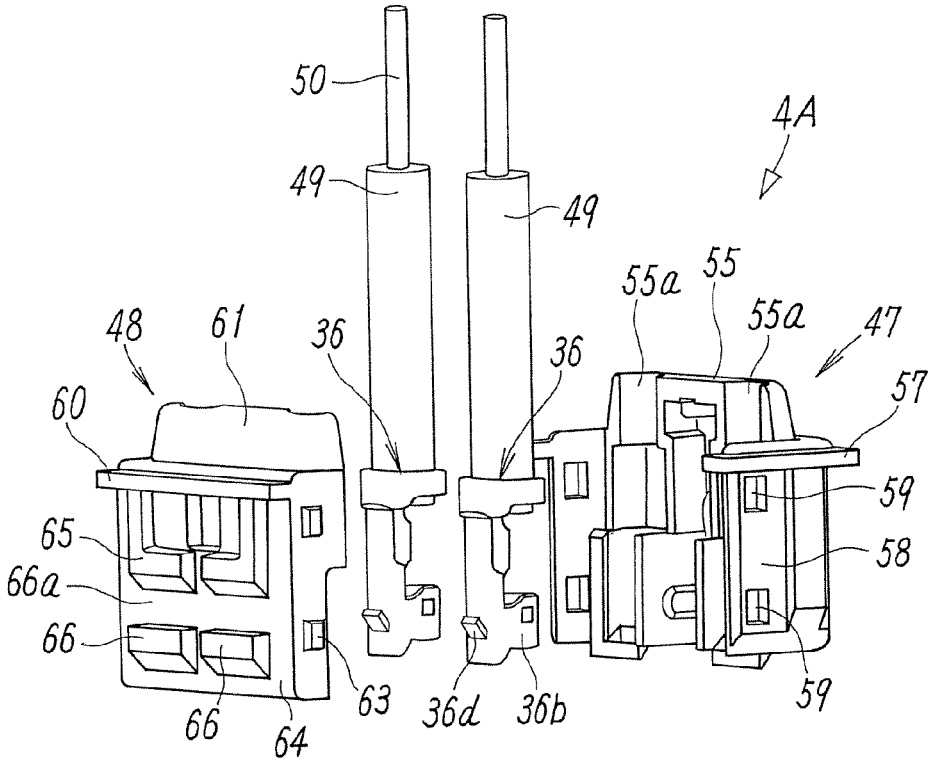
FIG. 8 is an exploded perspective view of the feeder socket of the second embodiment when viewed from the lid.
Figure 9:
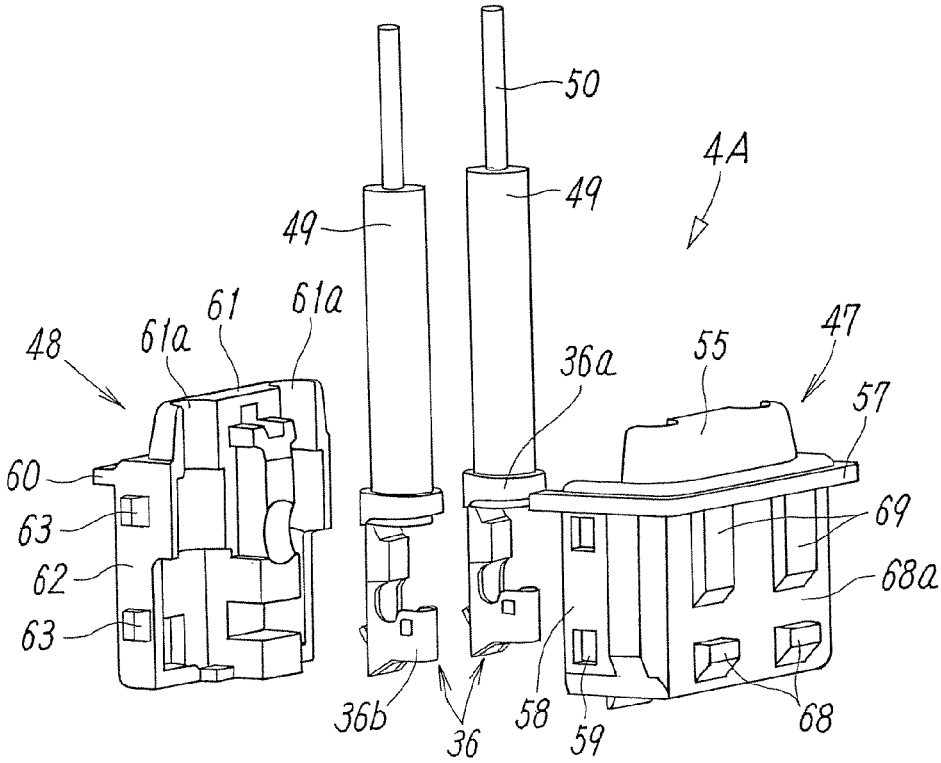
FIG. 9 is an exploded perspective view of the feeder socket of the second embodiment when viewed from the terminal storage box.

FIGS. 7 to 9 show a second embodiment of the feeder unit. The main characteristic of a feeder unit 4A according to the second embodiment, which is different from the feeder unit 4 according to the first embodiment will be described hereinafter. In the feeder unit 4 according to the first embodiment, the claws 66, 67 are formed on three surfaces, that is, the back surface 64 of the lid 48 and left and right side walls 58 of the terminal storage box 47, which form the housing 46 of the feeder socket 45, three walls of the socket hole 70 are formed as the elastic walls 74, 76 including the hooks 71, 75, respectively, and fixation of those claws 66, 67 to the hooks 71, 75 may fix the feeder socket 45 to the socket hole 70 at three planes. Meanwhile, in the feeder unit 4A according to the second embodiment, the feeder socket 45 is fixed to the socket hole 70 at two planes, that is, the back surface of the terminal storage box 47 and the back surface of the lid 48, which form the housing 46.

Specifically, the two first claws 66 are laterally arranged at a predetermined interval at the lower end of the back surface 64 of the lid 48. Two convex portions 65 are formed above those first claws 66. The recess portion 66*a* is defined by the upper convex portions 65 and the lower first claws 66. As described above, two third claws 68 are laterally arranged at a predetermined interval at the lower end of the back surface of the terminal storage box 47. The convex portions 69 are formed above the third claws 68. The recess portion 68*a* is defined by the third claws 68 and the convex portions 69.

Two opposite walls of the four walls that surround the socket hole 70 formed in the terminal cover 42, that is, the wall near the back surface 64 of the lid 48 of the feeder socket 45, and the wall near the back surface of the terminal storage box 47 are formed as the first and the third elastic walls 74 and 79, respectively each having the first and the third hooks 71 and 80 at the lower end.

When the feeder socket 45 is pushed into the socket hole 70, the first and the third hooks 71 and 80 at the lower ends of the first and the third elastic walls 74 and 79 are elastically widened temporarily by the first and the third claws 66 and 68. They are elastically fit with the recess portions 66*a* and 68*a*, respectively to be fixed to the lower ends of the first and the third claws 66 and 68. This allows the feeder socket 45 to be installed in the socket hole 70 in the fixed state.

The structures of the feeder socket 45 and the terminal cover 42 according to the second embodiment other than those described are substantially the same as those of the feeder socket 45 and the terminal cover 42 according to the first embodiment. The same main components as those of the first embodiment will be designated with the same reference numerals, and the explanations thereof, thus, will be omitted.

The feeder socket 45 may be fixed at any one of a plurality of planes without being fixed in the socket hole 70 at the plurality of planes as described in the respective embodiments. That is, any one of those walls of the socket hole 70 may be formed as the elastic wall to constitute the hook, and a claw may be formed on the outer surface of the feeder socket 45 opposite the elastic wall.

The invention claimed is:

1. An electromagnetic valve including an electromagnetic valve body formed of a passage switching unit and an electromagnetic operation unit for operating the passage switching unit, and a feeder unit for supplying power to the electromagnetic operation unit, characterized in that:

the feeder unit includes a power receiving terminal which is provided on a side surface of the electromagnetic valve body and conducted to the electromagnetic operation unit, a terminal cover attached onto the side surface of the electromagnetic valve body to cover the power receiving terminal, a socket hole formed at a position corresponding to the power receiving terminal covered by the terminal cover, and a feeder socket attached to a top end of a feeder cable so as to be installed within the socket hole;

the feeder socket includes a terminal storage box having a rectangular box shape and an open front surface and a lid for covering the open front surface of the terminal storage box, and the feeder cable and a feeder terminal are interposed between the terminal storage box and the lid which are connected with each other to integrally assemble the feeder socket to be installed within the socket hole such that the feeder terminal and the power receiving terminal are electrically coupled with each other;

at least one of a plurality of walls surrounding the socket hole is formed as an elastic wall including a top end section located at the side of an inlet of the socket hole located at an outer surface of the terminal cover and a tip section located at the depth side remote from the outer surface of the terminal cover; and a hook is formed on an inner surface of the tip section of the elastic wall, and a claw is formed on a plane opposite the elastic wall such that the feeder socket is installed in the socket hole so as not to be fallen out through an elastic engagement between the claw and the hook.

2. The electromagnetic valve according to claim 1, characterized in that semi-circular grooves are formed at opposite positions for introducing the feeder cable on the terminal storage box and the lid such that the feeder cable is gripped between the semi-circular grooves.

3. The electromagnetic valve according to claim 1, characterized in that a protrusion formed at one of the terminal storage box and the lid is fixed to a fixing window formed at the other one such that they are integrally connected with each other.

4. The electromagnetic valve according to claim 2, characterized in that a protrusion formed at one of the terminal storage box and the lid is fixed to a fixing window formed at the other one such that they are integrally connected with each other.

5. The electromagnetic valve according to claim 3, characterized in that the terminal storage box includes left and right elastically deformable side walls and a plurality of fixing windows formed on the side walls, and the lid is elastically fit with a portion between the left and the right side walls such that a plurality of the protrusions formed on both side surfaces of the lid are fixed to the fixing windows.

6. The electromagnetic valve according to claim 4, characterized in that the terminal storage box includes left and right elastically deformable side walls and a plurality of fixing windows formed on the side walls, and the lid is elastically fit with a portion between the left and the right side walls such that a plurality of the protrusions formed on both side surfaces of the lid are fixed to the fixing windows.

7. The electromagnetic valve according to claim 1, characterized in that two opposite walls of the socket hole are formed as the elastic walls, and the claws are formed on back surfaces of the terminal storage box and the lid of the feeder socket, respectively.

8. The electromagnetic valve according to claim 1, characterized in that the elastic walls extend to a depth of the hole from an end portion at the inlet side of the socket hole as a supporting point, and an end portion at the depth side is made elastically deformable to be close to or remote from the claws of the feeder socket.

9. The electromagnetic valve according to claim 1, characterized in that a stepped portion is formed to surround the top end of the socket hole, and flange portions are formed around an outer periphery of the top end of the feeder socket such that the flange portions abut against the stepped portion to be fixed upon insertion of the feeder socket into the socket hole.

10. The electromagnetic valve according to claim 3, characterized in that a stepped portion is formed to surround the top end of the socket hole, and flange portions are formed around an outer periphery of the top end of the feeder socket such that the flange portions abut against the stepped portion to be fixed upon insertion of the feeder socket into the socket hole.

* * * * *